US005655903A

United States Patent [19]

Fischer

[11] Patent Number: 5,655,903

[45] Date of Patent: Aug. 12, 1997

[54] COMBUSTION CHAMBER WITH PREMIXING BURNERS

[75] Inventor: Melchior Fischer, Oberwil-Lieli, Switzerland

[73] Assignee: Asea Brown Boveri AG, Baden, Switzerland

[21] Appl. No.: 552,307

[22] Filed: Nov. 2, 1995

[30] Foreign Application Priority Data

Nov. 23, 1994 [DE] Germany ..... 44 41 641.5

[51] Int. Cl.[6] ..... F24C 5/00; F23C 5/00

[52] U.S. Cl. ..... 431/353; 431/115; 431/350; 431/9

[58] Field of Search ..... 431/115, 8, 9, 431/350, 351, 353, 116

[56] References Cited

U.S. PATENT DOCUMENTS

| | | | |
|---|---|---|---|
| 2,904,417 | 9/1959 | Nuyl | 431/9 |
| 3,030,773 | 4/1962 | Johnson | 431/9 |
| 3,676,060 | 7/1972 | Bedetti | 431/9 |
| 3,852,020 | 12/1974 | Peczeli et al. | 431/9 |
| 5,118,283 | 6/1992 | Sattelmeyer | 431/351 |
| 5,127,821 | 7/1992 | Keller | 431/351 |

FOREIGN PATENT DOCUMENTS

| | | |
|---|---|---|
| 0321809B1 | 6/1989 | European Pat. Off. . |
| 0592717A1 | 4/1994 | European Pat. Off. . |

*Primary Examiner*—Carl D. Price
*Attorney, Agent, or Firm*—Burns, Doane, Swecker & Mathis, L.L.P.

[57] ABSTRACT

In a combustion chamber with at least one premixing burner (110) which is fastened by means of its burner outlet (118) to a front plate (54) bounding the combustion space of the combustion chamber (60), the gaseous fuel is introduced via gas inlet flow openings (117) arranged around a burner axis (100). The fuel is mixed with the combustion air prior to ignition. The fuel concentration at the burner outlet (118) is lower at the outer edge of the flow field generated by the premixing burner (110) than it is in the inner part of the flow field. The temperature of the combustion gases at the outer edge of the bonnet-shaped reverse-flow zone (121), which gases impinge on the combustion chamber wall (63), is lower than the average temperature of the combustion gases in the bonnet-shaped reverse-flow zone (121).

3 Claims, 1 Drawing Sheet

COMBUSTION CHAMBER WITH PREMIXING BURNERS

FIELD OF THE INVENTION

The invention relates to a combustion chamber with at least one premixing burner which is fastened by means of its burner outlet to a front plate bounding the combustion space of the combustion chamber and which is operated with gaseous fuel, the fuel being introduced via gas inlet flow openings which are arranged around a burner axis and the fuel being mixed with the combustion air prior to ignition.

DISCUSSION OF BACKGROUND

Premixing burners of this type are known, for example, from U.S. Pat. No. 4,932,861 to Keller et al. The air is put into rotation by the premixing burner, which is designed as a swirl body. This causes a reverse-flow zone in which the flame is stabilized. The flow velocity can be up to one hundred meters per second at the outer edge of the vortex generated by the premixing burner. In the inlet gaps gaseous fuel is injected, via a row of introduction openings, into the combustion air flowing from the compressor. These openings are, as a rule, evenly distributed over the entire gap, however, zones subjected to high thermal loads, so-called "hot spots", can occur in wall regions of the combustion chamber near the burner during the combustion of the gas mixture obtained in this manner. These zones are caused by the hot outlet gases which impinge at high flow velocities on the combustion chamber wall at the outer edge of the vortex. The "hot spots" can, furthermore, lead to the formation of undesirable oxides of nitrogen. The position of the "hot spots" changes with each type of operating condition, i.e. depending on whether the plant is operated at full load or part load or also, for example, as a function of the energy output of the fuel used.

Where improved cooling is provided to protect the combustion chamber wall, this is associated with disadvantages. In the case of convective cooling, a pressure drop occurs due to the necessary increase in the cooling air velocity and this reduces the efficiency. In the case of film air cooling, the film air is no longer available for combustion, so that the emission of oxides of nitrogen can be increased. It may be generally stated that the unnecessary cooling of zones which are not thermally loaded leads to increased emissions of carbon monoxide and that the exhaust gas temperature profile is impaired.

SUMMARY OF THE INVENTION

Accordingly, one object of this invention is to avoid "hot spots" in a combustion chamber with premixing burners of the type quoted at the beginning without the combustion chamber wall having to be cooled additionally.

In accordance with the invention, this is achieved by the fuel concentration at the burner outlet being lower at the outer edge of the flow field generated by the premixing burner than it is in the inner part of the flow field, in particular in the vicinity of the burner axis, and by the temperature of the combustion gases at the outer edge of the bonnet-shaped reverse-flow zone, which gases impinge on the combustion chamber wall, being lower than the average temperature of the combustion gases in the bonnet-shaped reverse-flow zone.

The advantages of the invention may, inter alia, be seen in the fact that there is a targeted reduction in the temperature of those combustion gases which impinge on the combustion chamber wall at the locations of the "hot spots". Furthermore, as a result, no sacrifices with respect to efficiency and no increase in the pollutant emission are to be expected. Introduction openings can also be closed off retrospectively with small outlay in the case of premixing burners which have already been installed.

When premixing burners of the double-cone type are used, it is particularly useful for the premixing burner to be rotated in such a way that the rotating combustion gases impinge on the combustion chamber wall as far as possible from the premixing burner. This reduces the impingement velocity of the combustion gases on the combustion chamber wall and, therefore, the loading on the combustion chamber wall.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein an embodiment example of the invention is diagrammatically represented using a premixing burner of the double-cone type, and wherein.

DESCRIPTION OF THE PREFERRED EMBODIMENTS

Figure 1:
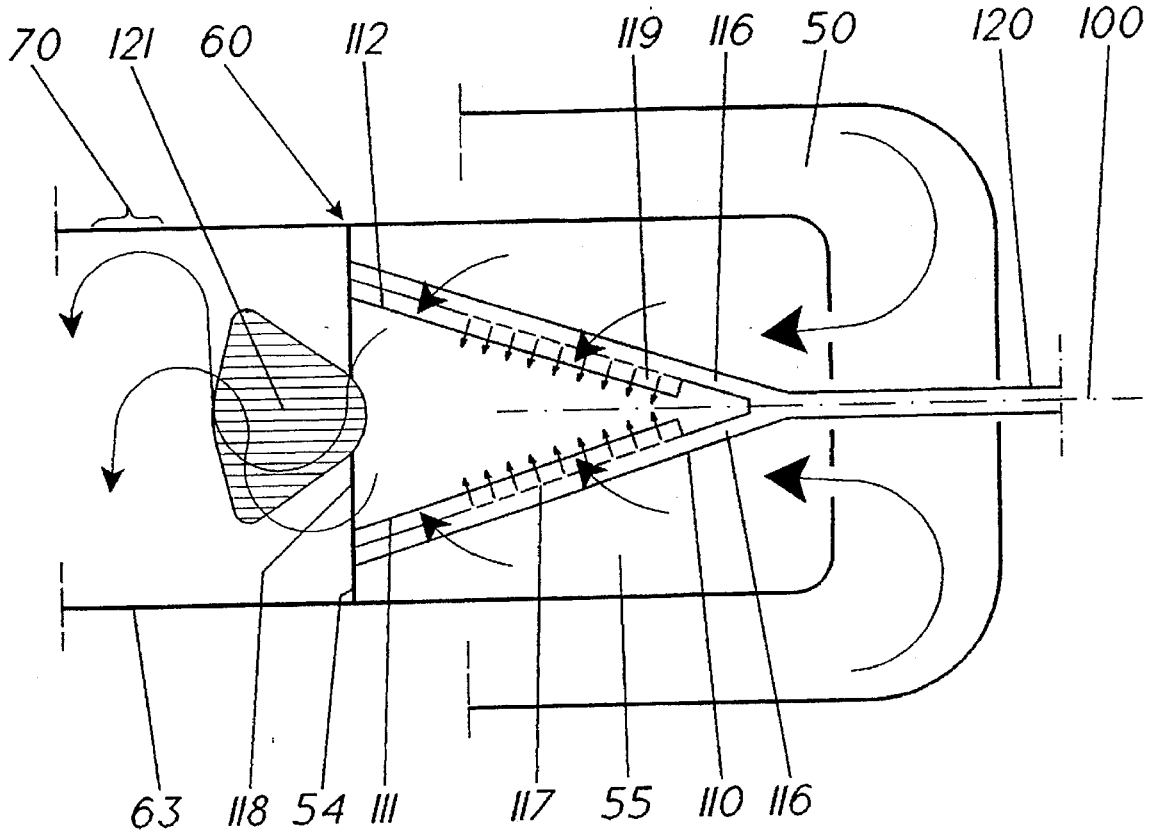
FIG. 1 shows a partial longitudinal section through a combustion chamber.

Referring now to the drawings, wherein like reference numerals designate identical or corresponding parts throughout the several views, in which the flow direction of the working media is indicated by arrows and in which only the elements essential to understanding the invention are shown (not represented, for example, are the arrangement or relative arrangement of the burner in the combustion chamber, the fuel preparation, the control devices and the like), FIG. 1 shows an enclosed plenum which is designated by 50 and which, as a rule, accepts the combustion air delivered by a compressor (not shown) and leads it to a combustion chamber 60. Either an individual combustion chamber or an annular combustion chamber can be used.

An annular dome 55 is placed on the top end of the combustion chamber, whose combustion space is enclosed by a combustion chamber wall 63 and bounded by a front plate 54. A burner 110 is arranged in this dome in such a way that the burner outlet 118 is at least approximately flush with the front plate 54. The combustion air flows out of the plenum 50 via the dome wall, which is perforated at its outer end, into the inner part of the dome and is admitted to the burner. The fuel is fed to the burner via a fuel lance 120 which penetrates the dome wall and the plenum wall.

Figure 2:
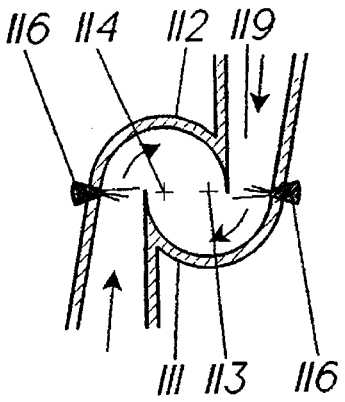
FIG. 2 shows a cross-section through the same premixing burner in the region of the apex of the cones.

The diagrammatically represented premixing burner 110 is a so-called double-cone burner such as is already known, for example, from U.S. Pat. No. 4,932,861 to Keller et al., quoted at the beginning. As may also be seen from FIGS. 2 and 3, it consists essentially of two hollow, conical partial bodies 111, 112 which are interleaved in the flow direction. The respective center lines 113, 114 of the two partial bodies are offset relative to one another. In their longitudinal extent, the adjacent walls of the two partial bodies form tangential slots 119 for the combustion air, which reaches the inside of the burner in this way.

In the case given as an example, the burner is operated with gaseous fuel. Gas inlet flow openings 117, which are distributed in the longitudinal direction in the walls of the two partial bodies and which are in the form of nozzles, are provided for this purpose in the region of the tangential slots. These nozzles are respectively supplied by one duct 116, which is, in turn, fed from the fuel lance 120. In such operation on gas, formation of the mixture with the combustion air has therefore already commenced in the zone of the inlet slots 119.

A fuel concentration which is as homogeneous as possible over the annular cross-section to which it is admitted forms at the burner outlet 118 of the burner 110. A defined bonnet-shaped recirculation zone 121, at whose apex ignition takes place, appears at the burner outlet. The flame itself is stabilized in front of the burner by the recirculation zone without the need for a mechanical flame holder.

The invention now provides for the fuel concentration, which is as homogeneous as possible, to be disturbed in a targeted manner and, in fact, in such a way that there is a higher fuel concentration in the outlet plane 118 of the burner in the region of the burner axis 100.

Figure 3:
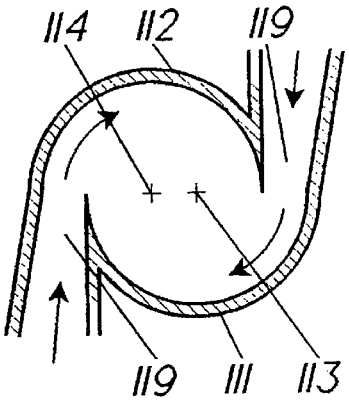
FIG. 3 shows a cross-section through a premixing burner of the double-cone type in the region of its outlet.

This is achieved by not providing any gas inlet flow openings 117 in the lower third, at most, of the tangential slots 119 upstream of the front plate 54 (FIG. 3). In the case of premixing burners which have already been installed, introduction openings located near the front plate 54 can be closed off by welding them up, for example. The other settings of the premixing burner can be left without modifications because the redistribution of the fuel only leads to a small increase in the average flame temperature. The increase in the emission of oxides of nitrogen is therefore negligible. If the temperature of the combustion gases which impinge at high velocities on the combustion chamber wall 63 at the "hot spots" 70 is reduced by 100 degrees Celsius, this can lead to a reduction of 50 degrees Celsius in the temperature of the combustion chamber wall.

When a plurality of premixing burners 110 is used, the position of the tangential slots 119 relative to the combustion chamber wall 63 of the premixing burners, which are located at the combustion chamber wall, has an influence on the position of the "hot spots" 70. The premixing burners 110 located in the vicinity of the combustion chamber wall 63 can be rotated in such a way that the rotating combustion gases impinge on the combustion chamber wall 63 as far as possible from the premixing burner. This reduces the impingement velocity of the combustion gases on the combustion chamber wall and, therefore, the thermal load on the combustion chamber wall. The optimum rotation of the premixing burners depends on the desired load, at which the impingement velocity of the combustion gases on the combustion chamber wall should be a minimum.

The invention is not, of course, limited to the embodiment example shown and described. Introduction openings 117 are, as a rule, only omitted near the front plate in the case of premixing burners near the combustion chamber wall. The number and arrangement of the introduction openings depends in each case on the desired reduction in the hot gas temperature at the combustion chamber wall. It is also possible to omit introduction openings near the front plate only in the case of one of the two tangential slots.

Furthermore, the invention is not fundamentally limited to premixing burners of the double-cone type in which the mixture enrichment takes place at the burner axis. On the contrary, it can be applied in all combustion chamber zones in which flame stabilization is generated by a dominant air velocity field.

With a view to mixed oil/gas operation, the double-cone burner represented could, furthermore, also be equipped, at the apex of the cones, with a liquid fuel nozzle located on the burner axis. The fuel can be introduced into the hollow cone from this nozzle at a certain angle. The resulting conical liquid fuel profile is enclosed by the combustion air which flows in tangentially. The concentration of the fuel is continuously reduced in the axial direction as a result of its being mixed with the combustion air.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A combustion chamber comprising a front plate and a combustion chamber wall enclosing a combustion space, at least one premixing burner mounted to the front plate adjacent to the combustion chamber wall, the premixing burner having a mixing space for fuel and combustion air, an outlet for mixed fuel and air, and a plurality of gas inlet openings to introduce fuel to the mixing space, wherein the at least one premixing burner is fastened by the burner outlet to the front plate to deliver a flow of mixed fuel and air to the combustion space, wherein upon combustion of the flow a bonnet-shaped reverse-flow zone is formed, wherein the gas inlet openings are arranged relative to a burner axis to introduce fuel into the mixing space so that a fuel concentration of the flow at the burner outlet relative to the axis is lower at a radially outer portion than at a radially inner portion, wherein a combustion gas flow temperature at a radially outer portion of the bonnet-shaped reverse-flow zone which impinges on the combustion chamber wall is lower than an average temperature in the bonnet-shaped reverse-flow zone.

2. The combustion chamber as claimed in claim 1, wherein the at least one premixing burner comprises two hollow, conical section bodies disposed to define a substantially conical interior space extending from a cone apex to the burner outlet, the bodies being offset relative to one another so that two tangential flow air inlet slots are formed along the axial direction of the interior space, wherein the gas inlet openings are disposed in at least one of the tangential flow inlet slots in a first two thirds of the tangential slot from the cone apex to the burner outlet.

3. The combustion chamber as claimed in claim 2, wherein the at least one premixing burner is disposed to position the tangential flow air slots of the premixing burner relative to the combustion chamber wall so that an impingement point of the combustion gases on the combustion chamber wall is a maximum distance from the burner outlet.

* * * * *